US009391354B2

(12) United States Patent
Ootsuka et al.

(10) Patent No.: US 9,391,354 B2
(45) Date of Patent: Jul. 12, 2016

(54) DIRECTIONAL COUPLER

(71) Applicant: TDK CORPORATION, Tokyo (JP)

(72) Inventors: Noriaki Ootsuka, Tokyo (JP); Yasunori Sakisaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/621,749

(22) Filed: Feb. 13, 2015

(65) Prior Publication Data

US 2015/0236666 A1 Aug. 20, 2015

(30) Foreign Application Priority Data

Feb. 18, 2014 (JP) ..... 2014-028120

(51) Int. Cl.
*H01P 5/18* (2006.01)
*H01P 3/08* (2006.01)

(52) U.S. Cl.
CPC ..... *H01P 5/185* (2013.01)

(58) Field of Classification Search
CPC ..... H01P 5/18; H01P 3/08
USPC ..... 333/109, 110, 111, 112, 116
See application file for complete search history.

(56) References Cited

U.S. PATENT DOCUMENTS 7,218,186 B2 * 5/2007 Chen ..... H01P 5/185 333/116
7,907,032 B2 * 3/2011 Yamamoto ..... H01P 5/18 333/116
2002/0186088 A1 12/2002 Ohta et al.
2012/0319797 A1 12/2012 Tamaru
2013/0300518 A1 * 11/2013 Tamaru ..... H01P 5/18 333/109

FOREIGN PATENT DOCUMENTS

JP 2002-368553 A 12/2002
JP 2006-222607 A 8/2006

OTHER PUBLICATIONS

Dec. 16, 2015 Office Action issued in Japanese Patent Application No. 2014-028120.

* cited by examiner

*Primary Examiner* — Dean Takaoka
(74) *Attorney, Agent, or Firm* — Oliff PLC

(57) ABSTRACT

A directional coupler includes: a main line connecting an input port and an output port; a first subline section and a second subline section each of which is formed of a line configured to be electromagnetically coupled to the main line; and a matching circuit provided between the first subline section and the second subline section. The matching circuit includes a first path connecting the first subline section and the second subline section, and a second path connecting the first path and the ground. The first path includes a first inductor. The second path includes a first capacitor and a second inductor connected in series.

4 Claims, 12 Drawing Sheets

DIRECTIONAL COUPLER

BACKGROUND OF THE INVENTION

1. Field of the Invention

The present invention relates to a wideband capable directional coupler.

2. Description of the Related Art

Directional couplers are used for detecting the levels of transmission/reception signals in transmission/reception circuits of wireless communication apparatuses such as cellular phones and wireless LAN communication apparatuses.

A directional coupler configured as follows is known as a conventional directional coupler. The directional coupler has an input port, an output port, a coupling port, a terminal port, a main line, and a subline. One end of the main line is connected to the input port, and the other end of the main line is connected to the output port. One end of the subline is connected to the coupling port, and the other end of the subline is connected to the terminal port. The main line and the subline are configured to be electromagnetically coupled to each other. The terminal port is grounded via a terminator having a resistance of 50Ω, for example. The input port receives a high frequency signal, and the output port outputs the same. The coupling port outputs a coupling signal having a power that depends on the power of the high frequency signal received at the input port.

Major parameters indicating the characteristics of directional couplers include insertion loss, coupling, isolation, directivity, and return loss at the coupling port. Definitions of these parameters will now be described. First, assume that the input port receives a high frequency signal of power P1. In this case, let P2 be the power of the signal output from the output port, P3 be the power of the signal output from the coupling port, and P4 be the power of the signal output from the terminal port. Further, assuming that the coupling port receives a high frequency signal of power P5, let P6 be the power of the signal reflected at the coupling port. Further, let IL represent insertion loss, C represent coupling, I represent isolation, D represent directivity, and RL represent return loss at the coupling port. These parameters are defined by the following equations.

$$IL=10\log(P2/P1)[\text{dB}]$$

$$C=10\log(P3/P1)[\text{dB}]$$

$$I=10\log(P3/P2)[\text{dB}]$$

$$D=10\log(P4/P3)[\text{dB}]$$

$$RL=10\log(P6/P5)[\text{dB}]$$

The coupling of the conventional directional coupler increases with increasing frequency of the high frequency signal received at the input port. The conventional directional coupler thus suffers from the problem that the frequency response of the coupling is not flat. Where coupling is denoted as −c (dB), an increase in coupling means a decrease in the value of c.

U.S. Patent Application Publication No. 2012/0319797 A1 discloses a directional coupler aiming to resolve the aforementioned problem. The directional coupler disclosed therein has a subline divided into a first subline and a second subline. One end of the first subline is connected to the coupling port. One end of the second subline is connected to the terminal port. A phase conversion unit is provided between the other end of the first subline and the other end of the second subline. The phase conversion unit causes a phase shift to be generated in a signal passing therethrough in such a manner that the absolute value of the phase shift monotonically increases within the range from 0 degree to 180 degrees as the frequency increases in a predetermined frequency band. The phase conversion unit is specifically a low-pass filter.

Mobile communication systems conforming to the Long Term Evolution (LTE) standard have become practically used in recent years, and further, practical use of mobile communication systems conforming to the LTE-Advanced standard, which is an evolution of the LTE standard, is under study. Carrier Aggregation (CA) is one of the key technologies of the LTE-Advanced standard. CA uses multiple carriers called component carriers simultaneously to enable wideband transmission.

A mobile communication apparatus operable under CA uses multiple frequency bands simultaneously. Accordingly, such a mobile communication apparatus requires a wideband capable directional coupler, that is, a directional coupler usable for multiple signals in multiple frequency bands.

The directional coupler disclosed in U.S. Patent Application Publication No. 2012/0319797 A1 has insufficient isolation in a frequency band not lower than the cut-off frequency of the low-pass filter. More specifically, where isolation is denoted as −i (dB), this directional coupler does not exhibit a sufficiently large value of i in a frequency band not lower than the cut-off frequency of the low-pass filter. Thus, this directional coupler does not work in a frequency band not lower than the cut-off frequency of the low-pass filter.

Some wireless communication apparatuses use two directional couplers connected in tandem. In such cases, the respective coupling ports of the two directional couplers are connected to each other. Reductions in signal reflection at the coupling port are thus demanded of the directional couplers. More specifically, it is demanded of the directional couplers that, where the return loss at the coupling port is denoted as −r (dB), the value of r be sufficiently large.

The directional coupler disclosed in U.S. Patent Application Publication No. 2012/0319797 A1, however, does not exhibit a sufficiently large value of r in a frequency band not lower than the cut-off frequency of the low-pass filter.

We proceed to explain why the directional coupler disclosed in the aforementioned U.S. publication does not exhibit sufficiently large values of i and r in a frequency band not lower than the cut-off frequency of the low-pass filter. In this directional coupler, there are formed a path connecting the connection point between the first subline and the low-pass filter to the ground via only a first capacitor, and a path connecting the connection point between the second subline and the low-pass filter to the ground via only a second capacitor. Consequently, in a frequency band not lower than the cut-off frequency of the low-pass filter, a high frequency signal going from the first subline to the low-pass filter mostly flows to the ground via the first capacitor, and a high frequency signal going from the second subline to the low-pass filter mostly flows to the ground via the second capacitor. Thus, in this directional coupler, the majority of the high frequency signal does not pass through the low-pass filter in a frequency band not lower than the cut-off frequency of the low-pass filter.

For the reason described above, the directional coupler disclosed in U.S. Patent Application Publication No. 2012/0319797 A1 is only usable over a limited frequency band lower than the cut-off frequency of the low-pass filter. Providing a wideband capable directional coupler is thus difficult with the technology described in the aforementioned U.S. publication.

OBJECT AND SUMMARY OF THE INVENTION

It is an object of the present invention to provide a wideband capable directional coupler.

A directional coupler of the present invention includes an input port, an output port, a coupling port, a terminal port, a main line, a first subline section, a second subline section, and a matching circuit. The main line connects the input port and the output port. Each of the first subline section and the second subline section is formed of a line configured to be electromagnetically coupled to the main line. The matching circuit is provided between the first subline section and the second subline section.

Each of the first subline section and the second subline section has a first end and a second end opposite to each other. The first end of the first subline section is connected to the coupling port. The first end of the second subline section is connected to the terminal port. The matching circuit includes a first path connecting the second end of the first subline section and the second end of the second subline section, and a second path connecting the first path and the ground. The first path includes a first inductor. The second path includes a first capacitor and a second inductor connected in series.

A combination of respective portions of the main line and the first subline section configured to be coupled to each other will be referred to as the first coupling section, and a combination of respective portions of the main line and the second subline section configured to be coupled to each other will be referred to as the second coupling section. In the directional coupler of the present invention, two signal paths are formed between the input port and the coupling port. One of the two signal paths passes through the first coupling section, and the other passes through the second coupling section and the matching circuit. Once the input port has received a high frequency signal, the coupling port outputs a coupling signal resulting from a combination of two signals having passed through the aforementioned two signal paths.

In the directional coupler of the present invention, the second inductor may have a first end and a second end, the first end being closest to the first path in terms of circuitry, the second end being closest to the ground in terms of circuitry, and the first capacitor may be provided between one end of the first inductor and the first end of the second inductor. In this case, the second path may further include a second capacitor provided between the other end of the first inductor and the first end of the second inductor.

In the directional coupler of the present invention, the first path may further include a third inductor connected to the first inductor in series. In this case, the second inductor may have a first end and a second end, the first end being closest to the first path in terms of circuitry, the second end being closest to the ground in terms of circuitry, and the first capacitor may be provided between the first end of the second inductor and the connection point between the first inductor and the third inductor.

In the directional coupler of the present invention, the second inductor may have an inductance higher than or equal to 0.1 nH.

As mentioned above, in the directional coupler of the present invention, once the input port has received a high frequency signal, the coupling port outputs a coupling signal resulting from a combination of a signal having passed through one of the two signal paths, i.e, the signal path through the first coupling section, and a signal having passed through the other signal path through the second coupling section and the matching circuit. The amount by which the phase of a signal is changed as the signal passes through the matching circuit varies as a function of the frequency of the signal. Accordingly, a phase difference between the two signals passing through the aforementioned two signal paths varies as a function of the frequency of the high frequency signal received at the input port. It is thus possible to suppress a change in the coupling of the directional coupler in response to a change in the frequency of the high frequency signal. Further, the matching circuit of the present invention allows a high frequency signal to pass therethrough over a wider frequency band when compared with a low-pass filter. Consequently, the present invention makes it possible to provide a wideband capable directional coupler.

Other and further objects, features and advantages of the invention will appear more fully from the following description.

DETAILED DESCRIPTION OF THE PREFERRED EMBODIMENTS

First Embodiment

Figure 1:
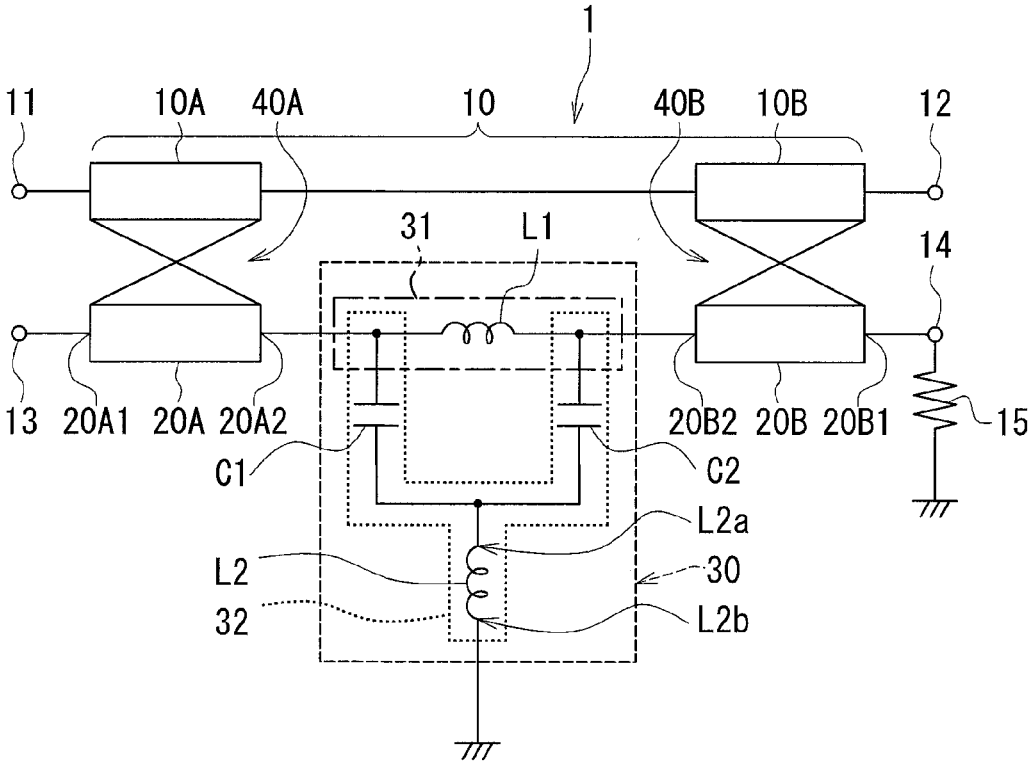
FIG. 1 is a circuit diagram illustrating the circuitry of a directional coupler according to a first embodiment of the invention.

Preferred embodiments of the present invention will now be described in detail with reference to the drawings. First, reference is made to FIG. 1 to describe the circuitry of a directional coupler according to a first embodiment of the invention. As shown in FIG. 1, the directional coupler 1 according to the first embodiment includes an input port 11, an output port 12, a coupling port 13, and a terminal port 14. The directional coupler 1 further includes: a main line 10 connecting the input port 11 and the output port 12; a first subline section 20A and a second subline section 20B each of which is formed of a line configured to be electromagnetically coupled to the main line 10; and a matching circuit 30 provided between the first subline section 20A and the second subline section 20B. The terminal port 14 is grounded via a terminator 15 having a resistance of, for example, 50Ω.

The first subline section 20A has a first end 20A1 and a second end 20A2 opposite to each other. The second subline section 20B has a first end 20B1 and a second end 20B2 opposite to each other. The first end 20A1 of the first subline section 20A is connected to the coupling port 13. The first end 20B1 of the second subline section 20B is connected to the terminal port 14.

The matching circuit 30 includes a first path 31 connecting the second end 20A2 of the first subline section 20A and the second end 20B2 of the second subline section 20B, and a second path 32 connecting the first path 31 and the ground. The first path 31 includes a first inductor L1.

The second path 32 includes a first capacitor C1 and a second inductor L2 connected in series. The second inductor L2 has a first end L2*a* and a second end L2*b*. In terms of circuitry, the first end L2*a* is closest to the first path 31, and the second end L2*b* is closest to the ground. The first capacitor C1 is provided between one end of the first inductor L1 and the first end L2*a* of the second inductor L2. In the present embodiment, the second path 32 further includes a second capacitor C2 provided between the other end of the first inductor L1 and the first end L2*a* of the second inductor L2. The second inductor L2 has an inductance higher than or equal to 0.1 nH. The inductance of the second inductor L2 is preferably not higher than 7 nH.

FIG. 1 illustrates an example in which the first capacitor C1 is provided between the coupling-port-side end (the end closer to the coupling port 13) of the first inductor L1 and the first end L2*a* of the second inductor L2, and the second capacitor C2 is provided between the terminal-port-side end (the end closer to the terminal port 14) of the first inductor L1 and the first end L2*a* of the second inductor L2. Alternatively, the first capacitor C1 may be provided between the terminal-port-side end of the first inductor L1 and the first end L2*a* of the second inductor L2, and the second capacitor C2 may be provided between the coupling-port-side end of the first inductor L1 and the first end L2*a* of the second inductor L2.

The main line 10 includes a first portion 10A configured to be electromagnetically coupled to the first subline section 20A, and a second portion 10B configured to be electromagnetically coupled to the second subline section 20B. A combination of respective portions of the main line 10 and the first subline section 20A configured to be coupled to each other, i.e., a combination of the first portion 10A and the first subline section 20A, will be referred to as the first coupling section 40A. A combination of respective portions of the main line 10 and the second subline section 20B configured to be coupled to each other, i.e., a combination of the second portion 10B and the second subline section 20B, will be referred to as the second coupling section 40B.

The matching circuit 30 is a circuit for performing impedance matching between a signal source and a load, assuming a situation in which the terminal port 14 is grounded via the terminator 15 serving as the load, and the coupling port 13 is connected with the signal source having an output impedance equal to the resistance of the terminator 15 (e.g., 50Ω). On the assumption of the above situation, the matching circuit 30 is designed so that the reflection coefficient as viewed in the direction from the coupling port 13 to the terminal port 14 has an absolute value of zero or near zero in the service frequency band of the directional coupler 1.

The operation and effects of the directional coupler 1 according to the first embodiment will now be described. A high frequency signal is received at the input port 11 and output from the output port 12. The coupling port 13 outputs a coupling signal having a power that depends on the power of the high frequency signal received at the input port 11.

A first signal path and a second signal path are formed between the input port 11 and the coupling port 13, the first signal path passing through the first coupling section 40A, the second signal path passing through the second coupling section 40B and the matching circuit 30. When a high frequency signal has been received at the input port 11, the coupling signal to be output from the coupling port 13 is a signal resulting from a combination of a signal having passed through the first signal path and a signal having passed through the second signal path. A phase difference occurs between the signal having passed through the first signal path and the signal having passed through the second signal path. The coupling of the directional coupler 1 depends on the coupling of each of the first coupling section 40A and the second coupling section 40B alone and the phase difference between the signal having passed through the first signal path and the signal having passed through the second signal path.

On the other hand, a third signal path and a fourth signal path are formed between the output port 12 and the coupling port 13, the third signal path passing through the first coupling section 40A, the fourth signal path passing through the second coupling section 40B and the matching circuit 30. The isolation of the directional coupler 1 depends on the coupling of each of the first coupling section 40A and the second coupling section 40B alone and a phase difference between a signal having passed through the third signal path and a signal having passed through the fourth signal path.

In the first embodiment, the first coupling section 40A, the second coupling section 40B and the matching circuit 30 have the function of suppressing a change in the coupling of the directional coupler 1 in response to a change in the frequency of the high frequency signal. This will be described in detail below.

The coupling of each of the first coupling section 40A and the second coupling section 40B alone increases with increasing frequency of the high frequency signal. In this case, given a fixed phase difference between the signal having passed through the first signal path and the signal having passed through the second signal path, the power of the coupling signal increases with increasing frequency of the high frequency signal.

On the other hand, given fixed values of the power of the signal having passed through the first signal path and the power of the signal having passed through the second signal path, the power of the coupling signal decreases as the phase difference between the signal having passed through the first signal path and the signal having passed through the second signal path increases within the range of 0° to 180°.

The amount by which the phase of a signal is changed as the signal passes through the matching circuit 30 varies as a function of the frequency of the signal. Accordingly, the phase difference between the signal having passed through the first signal path and the signal having passed through the second signal path varies as a function of the frequency of the high frequency signal received at the input port 11. Thus, designing the matching circuit 30 so that the aforementioned phase difference increases within the range of 0° to 180° with increasing frequency of the high frequency signal in the service frequency band of the directional coupler 1 allows for suppression of changes in the power of the coupling signal or changes in the coupling of the directional coupler 1 with increases in the frequency of the high frequency signal.

In the first embodiment, the matching circuit 30 provided between the first subline section 20A and the second subline section 20B allows for reduction in signal reflection at the coupling port 13 in the service frequency band of the directional coupler 1 where the terminal port 14 is grounded via the terminator 15 and the coupling port 13 is connected with a signal source having an output impedance equal to the resistance of the terminator 15 (e.g., 50Ω). This makes it possible to reduce signal reflection at the coupling port 13 in the case of using two directional couplers 1 connected in tandem, for example. This benefit will be discussed in more detail later.

Figure 2:
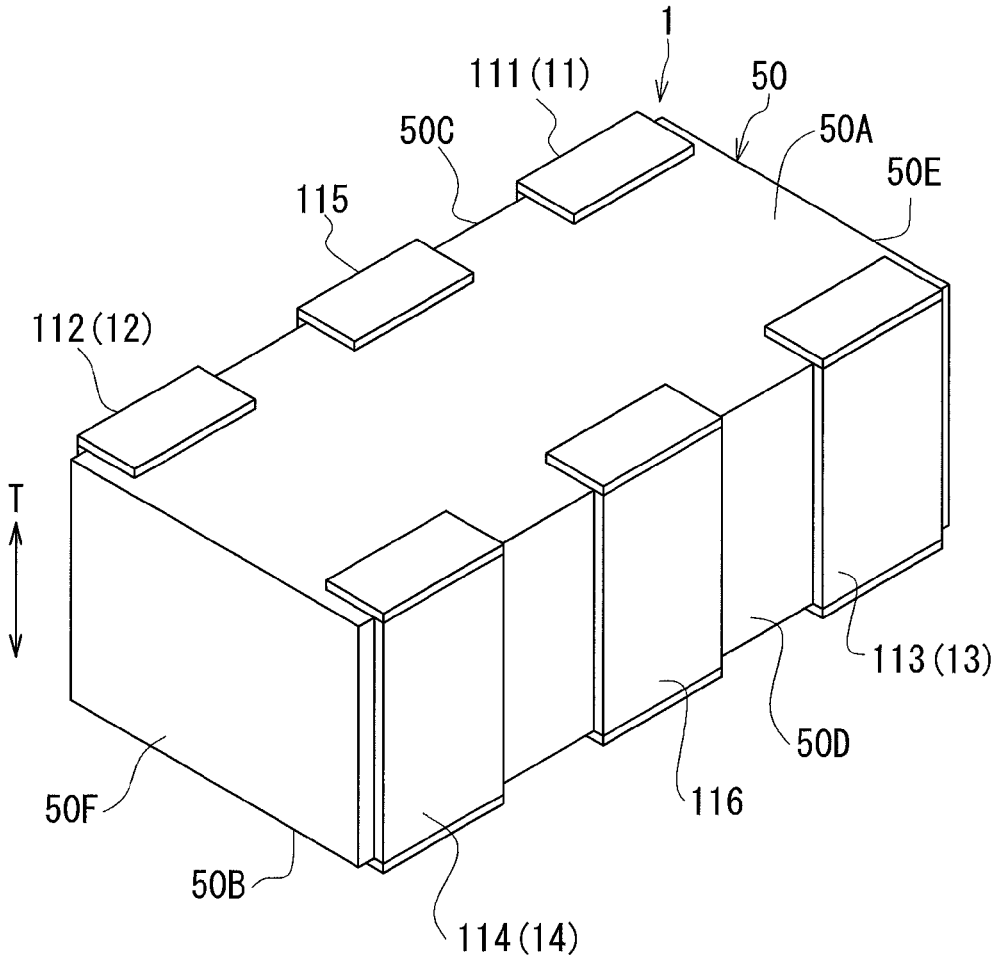
FIG. 2 is a perspective view of the directional coupler according to the first embodiment of the invention.

An example of the structure of the directional coupler 1 will now be described. FIG. 2 is a perspective view of the directional coupler 1. The directional coupler 1 shown in FIG. 2 includes a stack 50 for integrating the components of the directional coupler 1. As will be described in detail later, the stack 50 includes a plurality of stacked dielectric layers and conductor layers.

The stack 50 is shaped like a rectangular solid and has a periphery. The periphery of the stack 50 includes a top surface 50A, a bottom surface 50B, and four side surfaces 50C, 50D, 50E and 50F. The top surface 50A and the bottom surface 50B are opposite each other. The side surfaces 50C and 50D are opposite each other. The side surfaces 50E and 50F are opposite each other. The side surfaces 50C to 50F are perpendicular to the top surface 50A and the bottom surface 50B. For the stack 50, a direction perpendicular to the top surface 50A and the bottom surface 50B is the stacking direction of the plurality of dielectric layers and the plurality of conductor layers. The arrow labeled T in FIG. 2 indicates the stacking direction.

The directional coupler 1 shown in FIG. 2 has an input terminal 111, an output terminal 112, a coupling terminal 113, an end terminal 114, and two ground terminals 115 and 116. The input terminal 111, the output terminal 112, the coupling terminal 113 and the end terminal 114 correspond to the input port 11, the output port 12, the coupling port 13 and the terminal port 14 shown in FIG. 1, respectively. The ground terminals 115 and 116 are connected to the ground. The terminals 111 to 116 are provided on the periphery of the stack 50. The terminals 111, 112 and 115 are arranged to extend from the top surface 50A to the bottom surface 50B through the side surface 50C. The terminals 113, 114 and 116 are arranged to extend from the top surface 50A to the bottom surface 50B through the side surface 50D.

Figure 3:
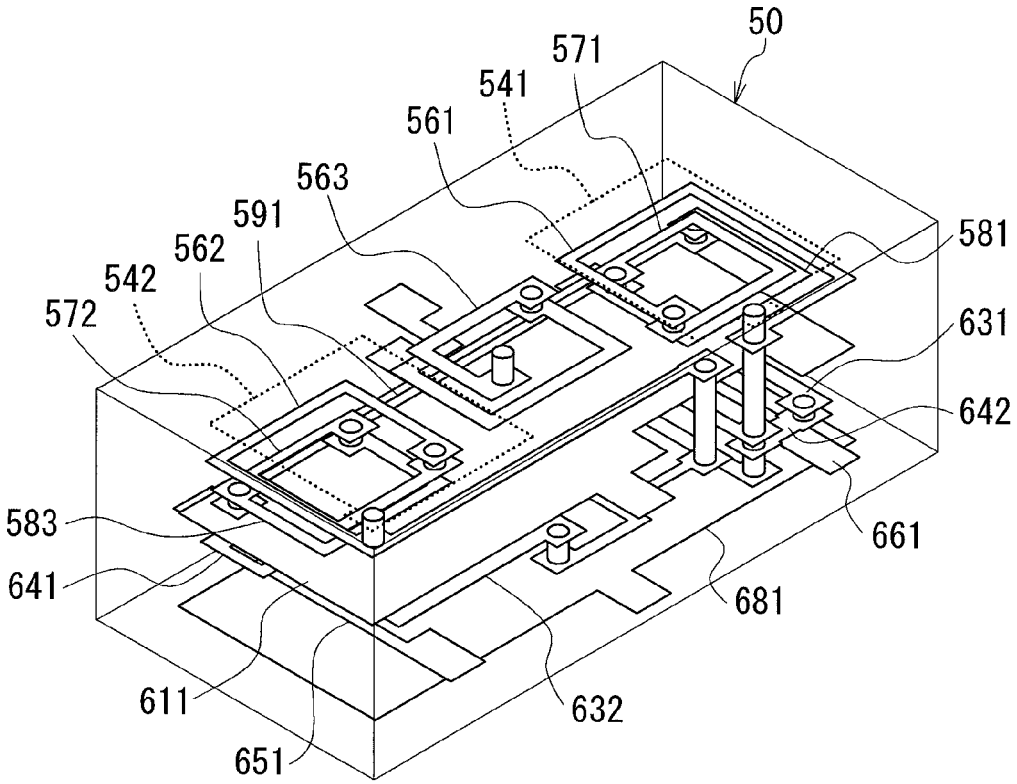
FIG. 3 is a perspective internal view of a stack included in the directional coupler shown in FIG. 2.
Figure 4:
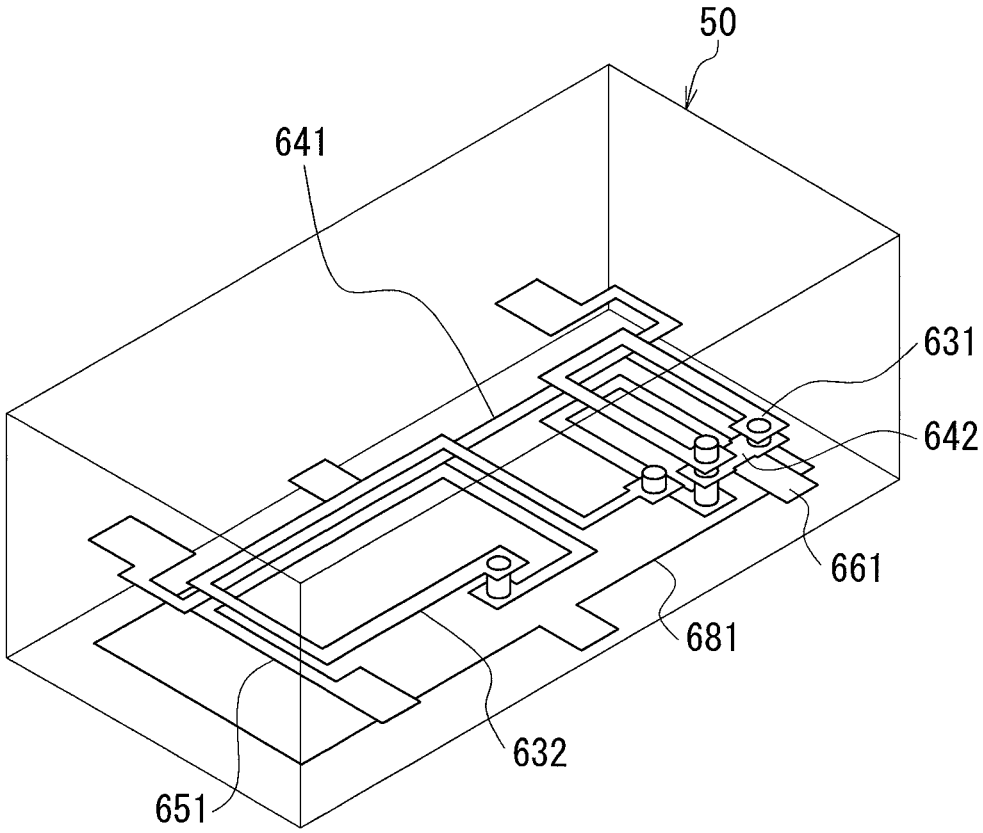
FIG. 4 is a perspective, partial internal view of the stack included in the directional coupler shown in FIG. 2.

The stack 50 will now be described in detail with reference to FIG. 3 to FIG. 9C. The stack 50 includes nineteen dielectric layers stacked on top of one another. The nineteen dielectric layers will be referred to as the first to nineteenth dielectric layers in the order from top to bottom. FIG. 3 is a perspective internal view of the stack 50. FIG. 4 is a perspective, partial internal view of the stack 50. FIG. 5A to FIG. 5D illustrate the top surfaces of the first to fourth dielectric layers, respectively. FIG. 6A to FIG. 6D illustrate the top surfaces of the fifth to eighth dielectric layers, respectively. FIG. 7A to FIG. 7D illustrate the top surfaces of the ninth to twelfth dielectric layers, respectively. FIG. 8A to FIG. 8D illustrate the top surfaces of the thirteenth to sixteenth dielectric layers, respectively. FIG. 9A to FIG. 9C illustrate the top surfaces of the seventeenth to nineteenth dielectric layers, respectively.

Figure 5A:
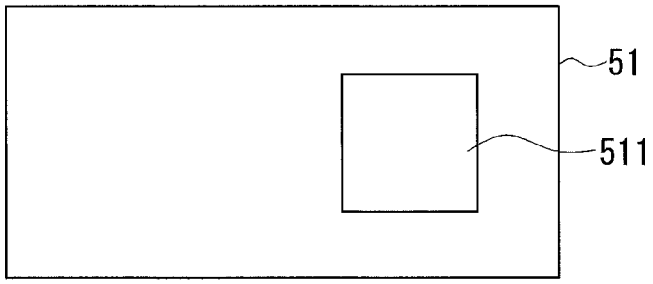
FIG. 5A to FIG. 5D are explanatory diagrams illustrating the respective top surfaces of the first to fourth dielectric layers of the stack included in the directional coupler shown in FIG. 2.
Figure 5B:
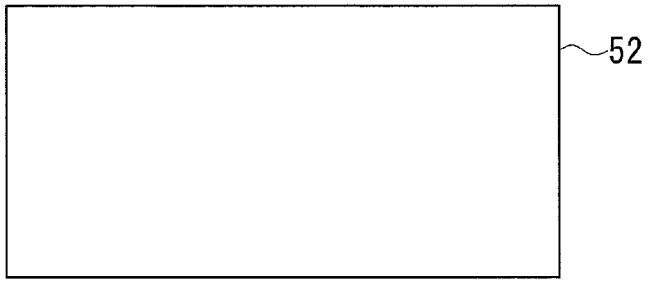

As shown in FIG. 5A, a conductor layer 511 for use as a mark is formed on the top surface of the first dielectric layer 51. As shown in FIG. 5B, no conductor layer is formed on the top surface of the second dielectric layer 52.

Figure 5C:
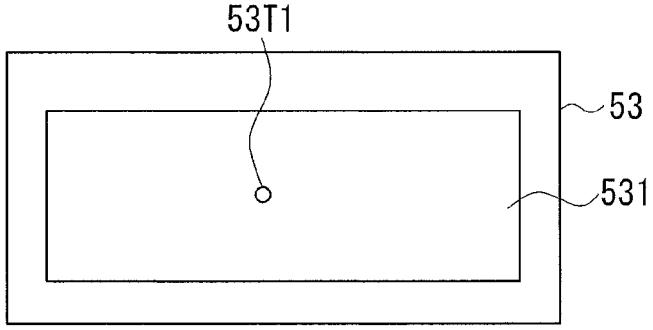

As shown in FIG. 5C, a conductor layer 531 is formed on the top surface of the third dielectric layer 53. The conductor layer 531 constitutes a portion of each of the capacitors C1 and C2. Further, a through hole 53T1 connected to the conductor layer 531 is formed in the dielectric layer 53.

Figure 5D:
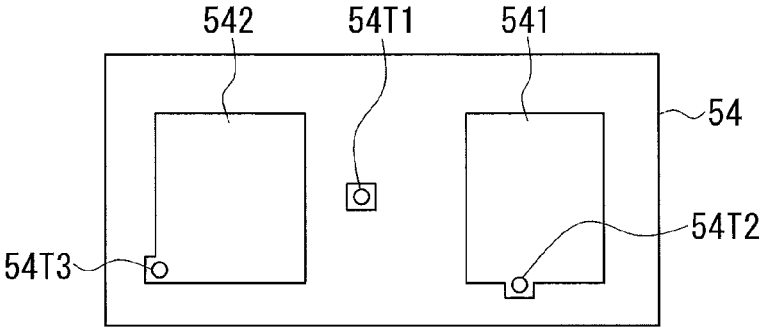

As shown in FIG. 5D, a conductor layer 541 and a conductor layer 542 are formed on the top surface of the fourth dielectric layer 54. The conductor layer 541 and the conductor layer 542 constitute other portions of the capacitor C1 and the capacitor C2, respectively. Further, in the dielectric layer 54 there are formed a through hole 54T1 connected to the through hole 53T1 shown in FIG. 5C, a through hole 54T2 connected to the conductor layer 541, and a through hole 54T3 connected to the conductor layer 542.

Figure 6A:
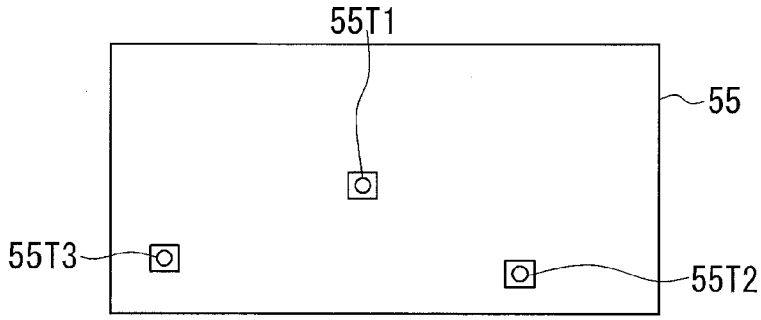
FIG. 6A to FIG. 6D are explanatory diagrams illustrating the respective top surfaces of the fifth to eighth dielectric layers of the stack included in the directional coupler shown in FIG. 2.

As shown in FIG. 6A, through holes 55T1, 55T2 and 55T3 are formed in the fifth dielectric layer 55. The through holes 54T1, 54T2 and 54T3 shown in FIG. 5D are connected to the through holes 55T1, 55T2 and 55T3, respectively.

Figure 6B:
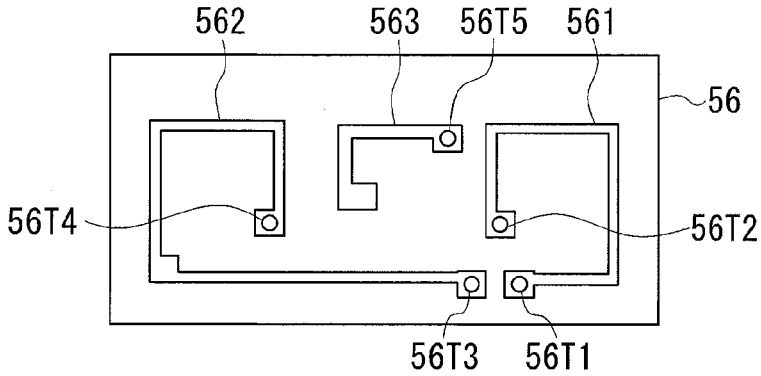

As shown in FIG. 6B, conductor layers 561, 562 and 563 are formed on the top surface of the sixth dielectric layer 56. The conductor layers 561 and 562 are for use to form the inductor L1. The conductor layer 563 is for use to form the inductor L2. Further, through holes 56T1, 56T2, 56T3, 56T4, and 56T5 are formed in the dielectric layer 56. The through hole 56T1 is connected to a portion of the conductor layer 561 near one end thereof. The through hole 56T2 is connected to a portion of the conductor layer 561 near the other end thereof. The through hole 56T3 is connected to a portion of the conductor layer 562 near one end thereof. The through hole 56T4 is connected to a portion of the conductor layer 562 near the other end thereof. The through hole 56T5 is connected to a portion of the conductor layer 563 near one end thereof. The through hole 55T1 shown in FIG. 6A is connected to a portion of the conductor layer 563 near the other end thereof. The through hole 55T2 shown in FIG. 6A is connected to the through hole 56T1. The through hole 55T3 shown in FIG. 6A is connected to a portion of the conductor layer 562 located between the one end and the other end thereof.

Figure 6C:
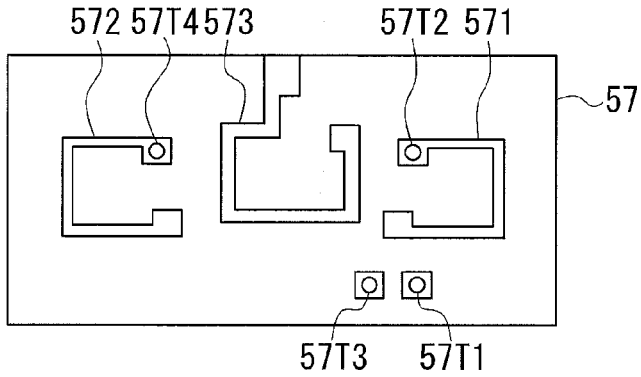

As shown in FIG. 6C, conductor layers 571, 572 and 573 are formed on the top surface of the seventh dielectric layer 57. The conductor layers 571 and 572 are for use to form the inductor L1. The conductor layer 573 is for use to form the inductor L2. Further, through holes 57T1, 57T2, 57T3 and 57T4 are formed in the dielectric layer 57. The through holes 56T1 and 56T3 shown in FIG. 6B are connected to the through holes 57T1 and 57T3, respectively. The through hole 57T2 is connected to a portion of the conductor layer 571 near one end thereof. The through hole 57T4 is connected to a portion of the conductor layer 572 near one end thereof. The through hole 56T2 shown in FIG. 6B is connected to a portion of the conductor layer 571 near the other end thereof. The through hole 56T4 shown in FIG. 6B is connected to a portion of the conductor layer 572 near the other end thereof. The through hole 56T5 shown in FIG. 6B is connected to a portion of the conductor layer 573 near one end thereof. The other end of the conductor layer 573 is connected to the ground terminal 115 shown in FIG. 2.

Figure 6D:
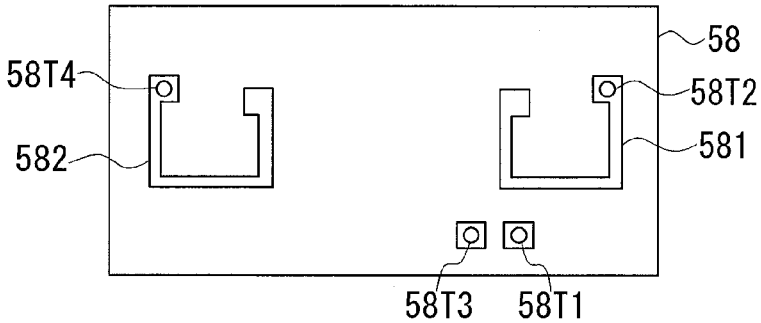

As shown in FIG. 6D, conductor layers 581 and 582 for use to form the inductor L1 are formed on the top surface of the eighth dielectric layer 58. Further, through holes 58T1, 58T2, 58T3 and 58T4 are formed in the dielectric layer 58. The through holes 57T1 and 57T3 shown in FIG. 6C are connected to the through holes 58T1 and 58T3, respectively. The through hole 58T2 is connected to a portion of the conductor layer 581 near one end thereof. The through hole 58T4 is connected to a portion of the conductor layer 582 near one end thereof. The through hole 57T2 shown in FIG. 6C is connected to a portion of the conductor layer 581 near the other end thereof. The through hole 57T4 shown in FIG. 6C is connected to a portion of the conductor layer 582 near the other end thereof.

Figure 7A:
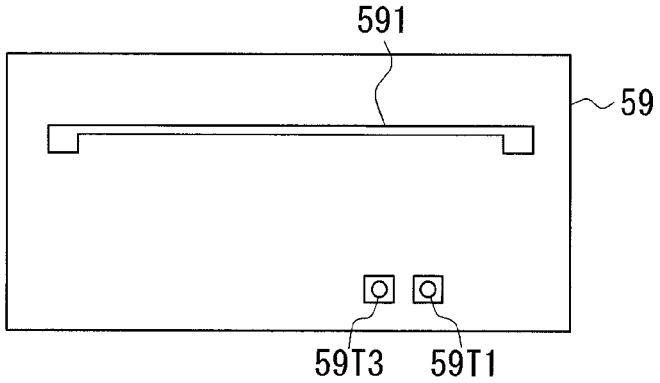
FIG. 7A to FIG. 7D are explanatory diagrams illustrating the respective top surfaces of the ninth to twelfth dielectric layers of the stack included in the directional coupler shown in FIG. 2.

As shown in FIG. 7A, a conductor layer 591 for use to form the inductor L1 is formed on the top surface of the ninth dielectric layer 59. Further, through holes 59T1 and 59T3 are formed in the dielectric layer 59. The through holes 58T1 and 58T3 shown in FIG. 6D are connected to the through holes 59T1 and 59T3, respectively. The through hole 58T2 shown in FIG. 6D is connected to a portion of the conductor layer 591 near one end thereof. The through hole 58T4 shown in FIG. 6D is connected to a portion of the conductor layer 591 near the other end thereof.

Figure 7B:
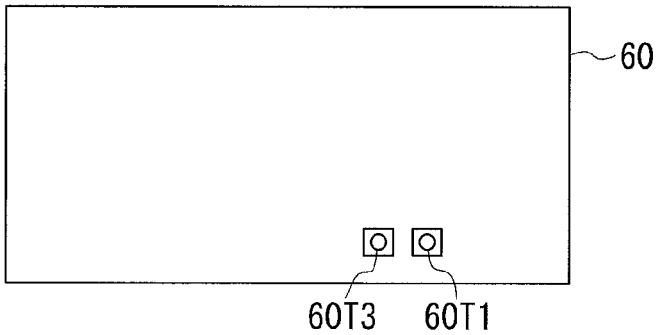

As shown in FIG. 7B, through holes 60T1 and 60T3 are formed in the tenth dielectric layer 60. The through holes 59T1 and 59T3 shown in FIG. 7A are connected to the through holes 60T1 and 60T3, respectively.

Figure 7C:
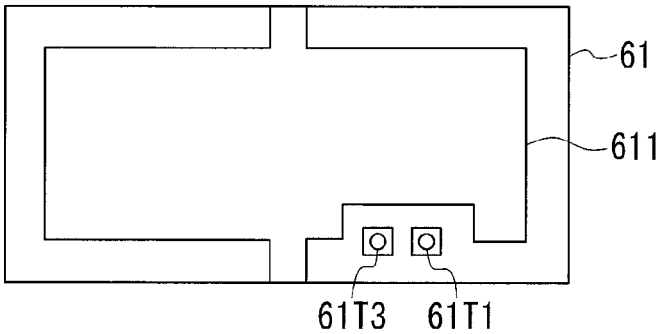

As shown in FIG. 7C, a ground conductor layer 611 is formed on the top surface of the eleventh dielectric layer 61. The ground conductor layer 611 is connected to the ground terminals 115 and 116 shown in FIG. 2. Further, through holes 61T1 and 61T3 are formed in the dielectric layer 61. The through holes 60T1 and 60T3 shown in FIG. 7B are connected to the through holes 61T1 and 61T3, respectively.

Figure 7D:
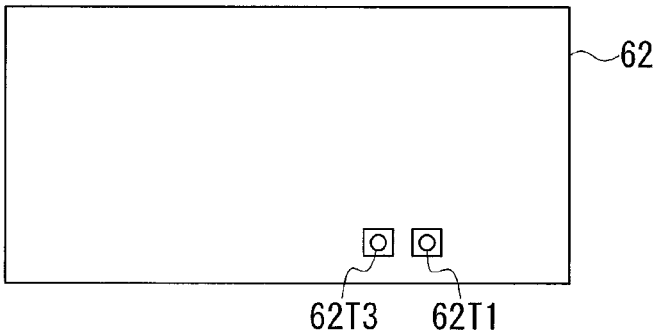

As shown in FIG. 7D, through holes 62T1 and 62T3 are formed in the twelfth dielectric layer 62. The through holes 61T1 and 61T3 shown in FIG. 7C are connected to the through holes 62T1 and 62T3, respectively.

Figure 8A:
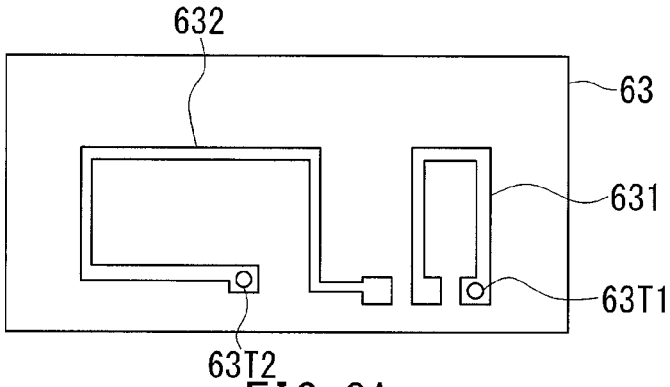
FIG. 8A to FIG. 8D are explanatory diagrams illustrating the respective top surfaces of the thirteenth to sixteenth dielectric layers of the stack included in the directional coupler shown in FIG. 2.
Figure 9A:
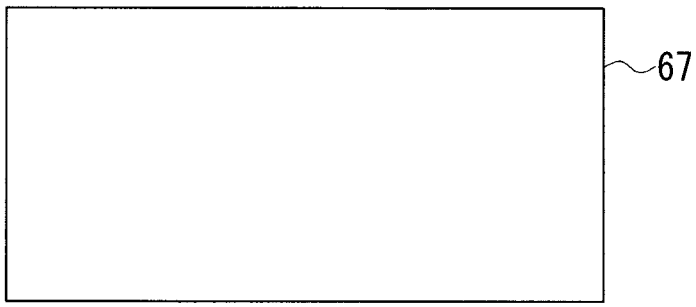
FIG. 9A to FIG. 9C are explanatory diagrams illustrating the respective top surfaces of the seventeenth to nineteenth dielectric layers of the stack included in the directional coupler shown in FIG. 2.
Figure 9B:
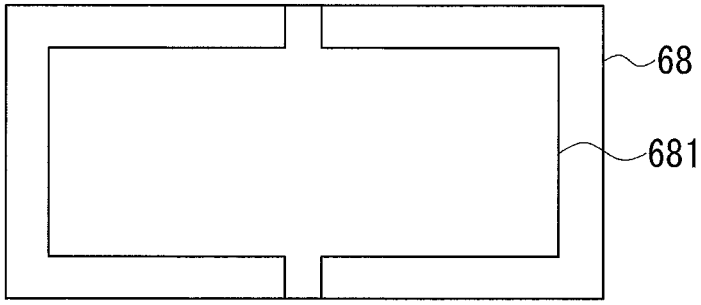
Figure 9C:
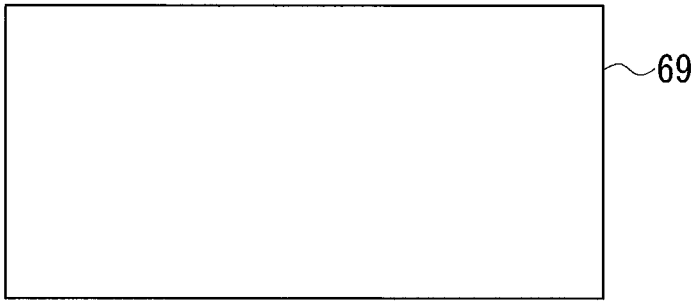

As shown in FIG. 8A, conductor layers 631 and 632 are formed on the top surface of the thirteenth dielectric layer 63. The conductor layer 631 is for use to form the first subline section 20A. The conductor layer 632 is for use to form the second subline section 20B. Further, through holes 63T1 and 63T2 are formed in the dielectric layer 63. The through hole 63T1 is connected to a portion of the conductor layer 631 near one end thereof. The through hole 63T2 is connected to a portion of the conductor layer 632 near one end thereof. The through hole 62T1 shown in FIG. 7D is connected to a portion of the conductor layer 631 near the other end thereof. The through hole 62T3 shown in FIG. 7D is connected to a portion of the conductor layer 632 near the other end thereof.

Figure 8B:
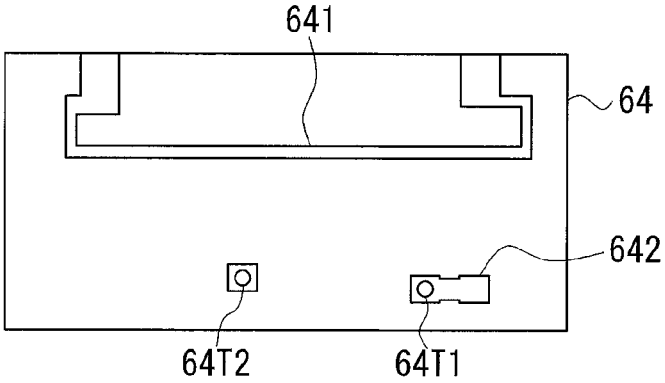

As shown in FIG. 8B, conductor layers 641 and 642 are formed on the top surface of the fourteenth dielectric layer 64. The conductor layer 641 is for use to form the main line 10. One end of the conductor layer 641 is connected to the input terminal 111 shown in FIG. 2. The other end of the conductor layer 641 is connected to the output terminal 112 shown in FIG. 2. Further, through holes 64T1 and 64T2 are formed in the dielectric layer 64. The through hole 64T1 is connected to a portion of the conductor layer 642 near one end thereof. The through hole 63T1 shown in FIG. 8A is connected to a portion of the conductor layer 642 near the other end thereof. The through hole 63T2 shown in FIG. 8A is connected to the through hole 64T2.

Figure 8C:
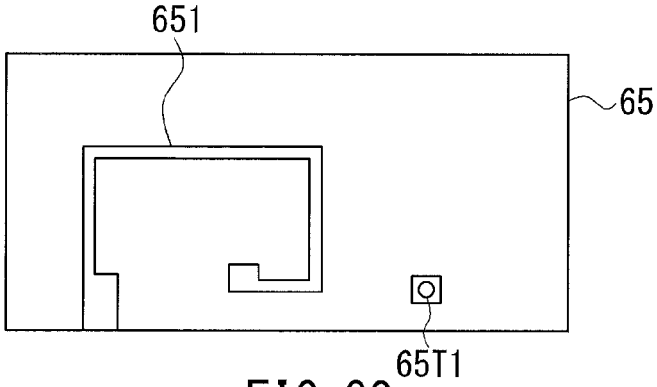

As shown in FIG. 8C, a conductor layer 651 for use to form the second subline section 20B is formed on the top surface of the fifteenth dielectric layer 65. One end of the conductor layer 651 is connected to the end terminal 114 shown in FIG. 2. Further, a through hole 65T1 is formed in the dielectric layer 65. The through hole 64T1 shown in FIG. 8B is connected to the through hole 65T1. The through hole 64T2 shown in FIG. 8B is connected to a portion of the conductor layer 651 near the other end thereof.

Figure 8D:
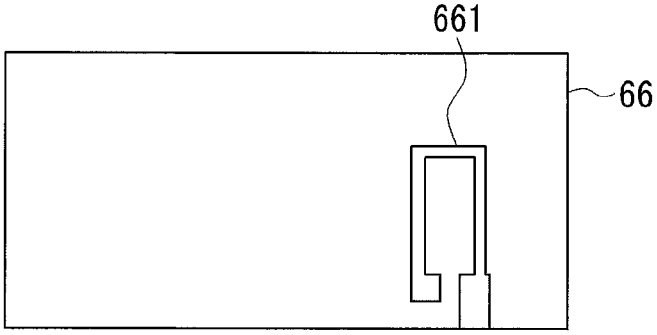

As shown in FIG. 8D, a conductor layer 661 for use to form the first subline section 20A is formed on the top surface of the sixteenth dielectric layer 66. One end of the conductor layer 661 is connected to the coupling terminal 113 shown in FIG. 2. The through hole 65T1 shown in FIG. 8C is connected to a portion of the conductor layer 661 near the other end thereof.

As shown in FIG. 9A, no conductor layer is formed on the top surface of the seventeenth dielectric layer 67. As shown in FIG. 9B, a ground conductor layer 681 is formed on the top surface of the eighteenth dielectric layer 68. The conductor layer 681 is connected to the ground terminals 115 and 116 shown in FIG. 2. As shown in FIG. 9C, no conductor layer is formed on the top surface of the nineteenth dielectric layer 69.

The stack 50 shown in FIG. 2 is formed by stacking the first to nineteenth dielectric layers 51 to 69. Then, the terminals 111 to 116 are formed on the periphery of the stack 50 to complete the directional coupler 1 shown in FIG. 2. FIG. 2 omits the illustration of the conductor layer 511.

FIG. 3 shows the interior of the stack 50. FIG. 3 omits the illustration of the conductor layer 531 and shows the conductor layers 541 and 542 in dotted lines. FIG. 4 shows part of the interior of the stack 50. FIG. 4 omits the illustration of some of the conductor layers that are located on or above the conductor layers 631 and 632.

Correspondences of the circuit components of the directional coupler 1 shown in FIG. 1 with the components inside the stack 50 shown in FIG. 5A to FIG. 9C will now be described. The main line 10 is formed by the conductor layer 641 shown in FIG. 8B.

The first subline section 20A is formed as follows. The conductor layer 631 shown in FIG. 8A is connected to the conductor layer 661 shown in FIG. 8D via the through hole 63T1, the conductor layer 642 and the through holes 64T1 and 65T1. A portion of the conductor layer 631 is opposed to the top surface of a first portion of the conductor layer 641 with the dielectric layer 63 interposed therebetween. A portion of the conductor layer 661 is opposed to the bottom surface of the first portion of the conductor layer 641 with the dielectric layers 64 and 65 interposed therebetween. The aforementioned portion of the conductor layer 631 and the aforementioned portion of the conductor layer 661 constitute the first subline section 20A. The first portion of the conductor layer 641, to which the aforementioned portions of the conductor layers 631 and 661 are opposed, constitutes the first portion 10A of the main line 10.

The second subline section 20B is formed as follows. The conductor layer 632 shown in FIG. 8A is connected to the conductor layer 651 shown in FIG. 8C via the through holes 63T2 and 64T2. A portion of the conductor layer 632 is opposed to the top surface of a second portion of the conductor layer 641 with the dielectric layer 63 interposed therebetween. A portion of the conductor layer 651 is opposed to the bottom surface of the second portion of the conductor layer 641 with the dielectric layer 64 interposed therebetween. The aforementioned portion of the conductor layer 632 and the aforementioned portion of the conductor layer 651 constitute the second subline section 20B. The second portion of the conductor layer 641, to which the aforementioned portions of the conductor layers 632 and 651 are opposed, constitutes the second portion 10B of the main line 10.

The inductor L1 of the matching circuit 30 is formed as follows. The conductor layers 561, 571 and 581 shown in FIG. 6B to FIG. 6D are connected to each other in series via the through holes 56T2 and 57T2. The conductor layers 562, 572 and 582 shown in FIG. 6B to FIG. 6D are connected to each other in series via the through holes 56T4 and 57T4. The conductor layers 581 and 582 shown in FIG. 6D are connected to each other in series via the through holes 58T2 and 58T4 and the conductor layer 591 shown in FIG. 7A. The inductor L1 is constituted by these conductor layers 561, 571, 581, 591, 582, 572 and 562 and the through holes connecting them. The conductor layer 561 is connected via the through holes 56T1, 57T1, 58T1, 59T1, 60T1, 61T1 and 62T1 to the conductor layer 631 constituting part of the first subline section 20A. The conductor layer 562 is connected via the through holes 56T3, 57T3, 58T3, 59T3, 60T3, 61T3 and 62T3 to the conductor layer 632 constituting part of the second subline section 20B.

The capacitor C1 of the matching circuit 30 is constituted by the conductor layer 541 shown in FIG. 5D, the conductor layer 531 shown in FIG. 5C, and the dielectric layer 53 interposed therebetween. The conductor layer 541 is connected via the through holes 54T2, 55T2, 56T1, 57T1, 58T1, 59T1, 60T1, 61T1 and 62T1 to the conductor layer 631 constituting part of the first subline section 20A.

The capacitor C2 of the matching circuit 30 is constituted by the conductor layer 542 shown in FIG. 5D, the conductor layer 531 shown in FIG. 5C, and the dielectric layer 53 interposed therebetween. The conductor layer 542 is connected via the through holes 54T3 and 55T3, the conductor layer 562 and the through holes 56T3, 57T3, 58T3, 59T3, 60T3, 61T3 and 62T3 to the conductor layer 632 constituting part of the second subline section 20B.

The inductor L2 of the matching circuit 30 is constituted by the conductor layer 563 shown in FIG. 6B, the conductor layer 573 shown in FIG. 6C, and the through hole 56T5 connecting them. The conductor layer 563 is connected via the through holes 53T1, 54T1 and 55T1 to the conductor layer 531 shown in FIG. 5C.

In the stack 50, the ground conductor layer 611 connected to the ground is interposed between the conductor layer 641 constituting the main line 10 and the conductor layers constituting the matching circuit 30. Thus, the matching circuit 30 is not configured to be electromagnetically coupled to the main line 10.

Figure 10:
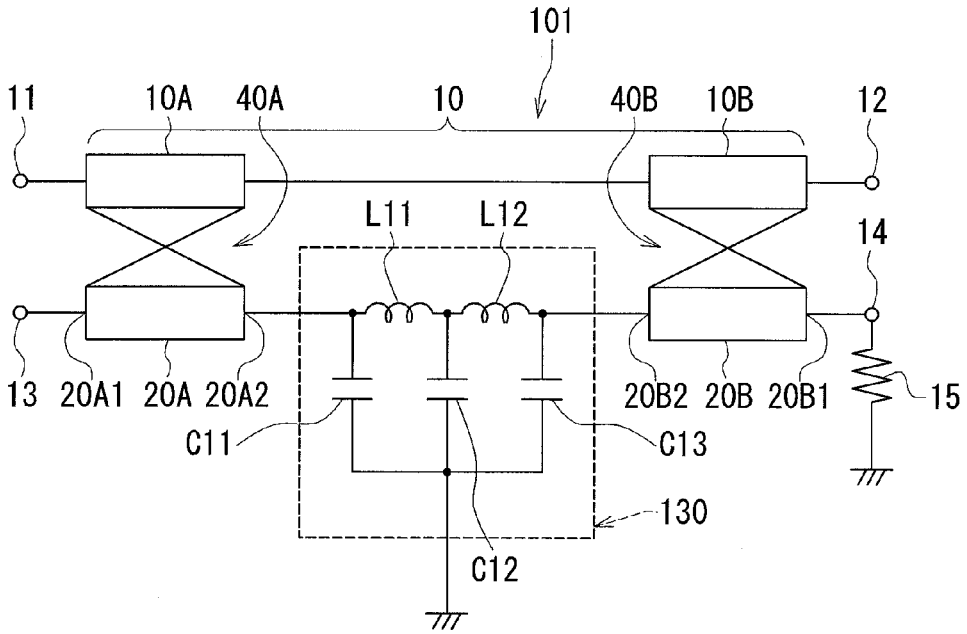
FIG. 10 RELATED ART
FIG. 10 is a circuit diagram illustrating the circuitry of a directional coupler of a comparative example.

Now, the effects of the directional coupler 1 according to the first embodiment will be described in more detail in comparison with a directional coupler of a comparative example. First, reference is made to FIG. 10 to describe the circuitry of the directional coupler 101 of the comparative example. The directional coupler 101 of the comparative example includes a low-pass filter 130 provided between the first subline section 20A and the second subline section 20B, in place of the matching circuit 30 of the first embodiment.

The low-pass filter 130 includes two inductors L11 and L12, and three capacitors C11, C12 and C13. One end of the inductor L11 is connected to the second end 20A2 of the first subline section 20A. One end of the inductor L12 is connected to the second end 20B2 of the second subline section 20B. The other end of the inductor L11 and the other end of the inductor L12 are connected to each other. One end of the capacitor C11 is connected to the connection point between the first subline section 20A and the inductor L11. One end of the capacitor C12 is connected to the connection point between the inductor L11 and the inductor L12. One end of the capacitor C13 is connected to the connection point between the second subline section 20B and the inductor L12. The other end of each of the capacitors C11, C12 and C13 is grounded. The remainder of configuration of the directional coupler 101 of the comparative example is the same as that of the directional coupler 1 according to the first embodiment.

Figure 11:
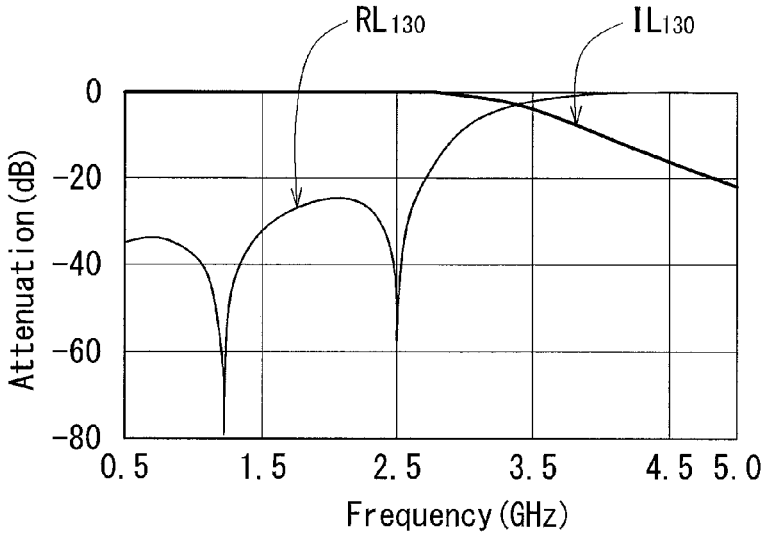
FIG. 11 RELATED ART
FIG. 11 is a characteristic diagram illustrating the characteristics of a low-pass filter of the directional coupler of the comparative example.

FIG. 11 is a characteristic diagram illustrating the characteristics of the low-pass filter 130 of the directional coupler 101 of the comparative example. In FIG. 11 the horizontal axis represents frequency, and the vertical axis represents attenuation. In FIG. 11 the line labeled $IL_{130}$ indicates the insertion loss of the low-pass filter 130 as viewed from the connection point between the first subline section 20A and the low-pass filter 130, and the line $RL_{130}$ indicates the return loss of the low-pass filter 130 as viewed from the connection point between the first subline section 20A and the low-pass filter 130. The low-pass filter 130 has a cut-off frequency of approximately 3.4 GHz. For the low-pass filter 130, where the insertion loss and the return loss thereof are denoted as −x (dB) and −y (dB), respectively, the value of x increases and the value of y decreases with increasing frequency in a frequency band not lower than approximately 2.7 GHz.

Figure 12:
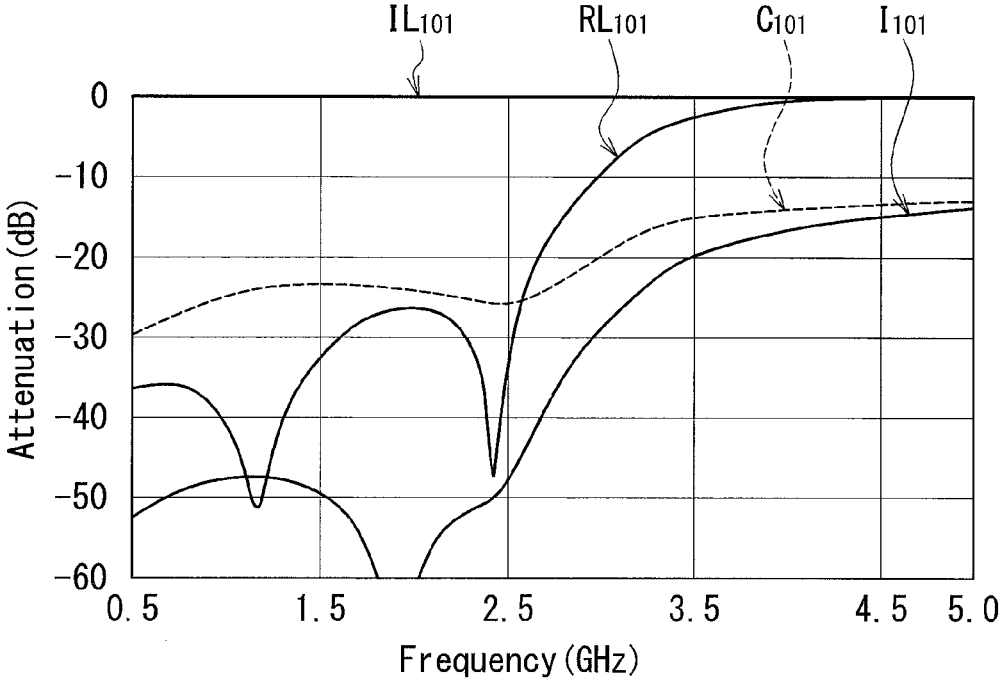
FIG. 12 RELATED ART
FIG. 12 is a characteristic diagram illustrating the characteristics of the directional coupler of the comparative example.

FIG. 12 is a characteristic diagram illustrating the characteristics of the directional coupler 101 of the comparative example. In FIG. 12 the horizontal axis represents frequency, and the vertical axis represents attenuation. In FIG. 12, the line labeled $IL_{101}$ indicates the insertion loss of the directional coupler 101; the line labeled $C_{101}$ indicates the coupling of the directional coupler 101; the line labeled $I_{101}$ indicates the isolation of the directional coupler 101; and the line labeled $RL_{101}$ indicates the return loss at the coupling port 13 of the directional coupler 101.

For the directional coupler 101, where the isolation and the return loss at the coupling port 13 thereof are denoted as −i (dB) and −r (dB), respectively, the value of i is 25 or below and increases with increasing frequency in a frequency band not lower than approximately 3.2 GHz. Further, in a frequency band not lower than approximately 2.7 GHz, the value of r is 20 or below and decreases with increasing frequency. These facts indicate that the directional coupler 101 is unable to exhibit sufficient characteristics as a directional coupler in a frequency band not lower than approximately 2.7 GHz, and does not work in a frequency band not lower than the cut-off frequency of the low-pass filter 130.

We proceed to explain why the directional coupler 101 does not work in a frequency band not lower than the cut-off frequency of the low-pass filter 130. In the directional coupler 101, there are formed a path connecting the connection point between the first subline section 20A and the low-pass filter 130 to the ground via only the capacitor C11, and a path connecting the connection point between the second subline section 20B and the low-pass filter 130 to the ground via only the capacitor C13. Consequently, in a frequency band not lower than the cut-off frequency of the low-pass filter 130, a high frequency signal going from the first subline section 20A to the low-pass filter 130 mostly flows to the ground via the capacitor C11, and a high frequency signal going from the second subline section 20B to the low-pass filter 130 mostly flows to the ground via the capacitor C13. Thus, the majority of the high frequency signal does not pass through the low-pass filter 130 in a frequency band not lower than the cut-off frequency of the low-pass filter 130. As a result, the low-pass filter 130 and the second coupling section 40B do not work in a frequency band not lower than the cut-off frequency of the low-pass filter 130. In this case, a signal going from the input port 11 to the coupling port 13 and a signal going from the output port 12 to the coupling port 13 both pass through only the first coupling section 40A and not through the second coupling section 40B. Consequently, in a frequency band not lower than the cut-off frequency of the low-pass filter 130, the coupling and the isolation of the directional coupler 101 become almost equal, and thus the directional coupler 101 does not work.

Figure 13:
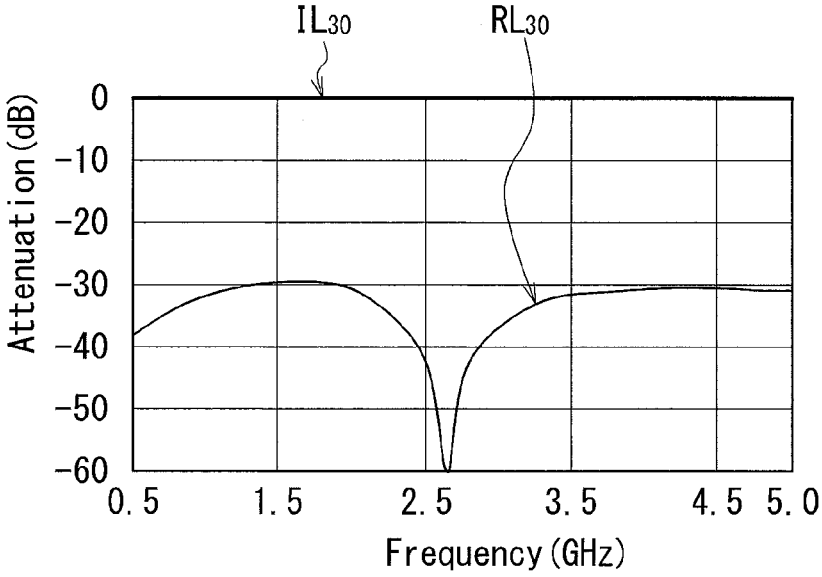
FIG. 13 is a characteristic diagram illustrating an example of characteristics of a matching circuit of the directional coupler according to the first embodiment of the invention.

Now, an example of characteristics of the matching circuit 30 of the directional coupler 1 according to the first embodiment and an example of characteristics of the directional coupler 1 according to the first embodiment will be described. FIG. 13 is a characteristic diagram illustrating an example of characteristics of the matching circuit 30. In FIG. 13 the horizontal axis represents frequency, and the vertical axis represents attenuation. In FIG. 13 the line labeled $IL_{30}$ indicates the insertion loss of the matching circuit 30 as viewed from the connection point between the first subline section 20A and the matching circuit 30, and the line $RL_{30}$ indicates the return loss of the matching circuit 30 as viewed from the connection point between the first subline section 20A and the matching circuit 30. For the matching circuit 30, where the insertion loss and the return loss thereof are denoted as −x (dB) and −y (dB), respectively, the value of x is almost zero and the value of y is approximately 30 or above in the 0.5- to 5.0-GHz frequency band.

Figure 14:
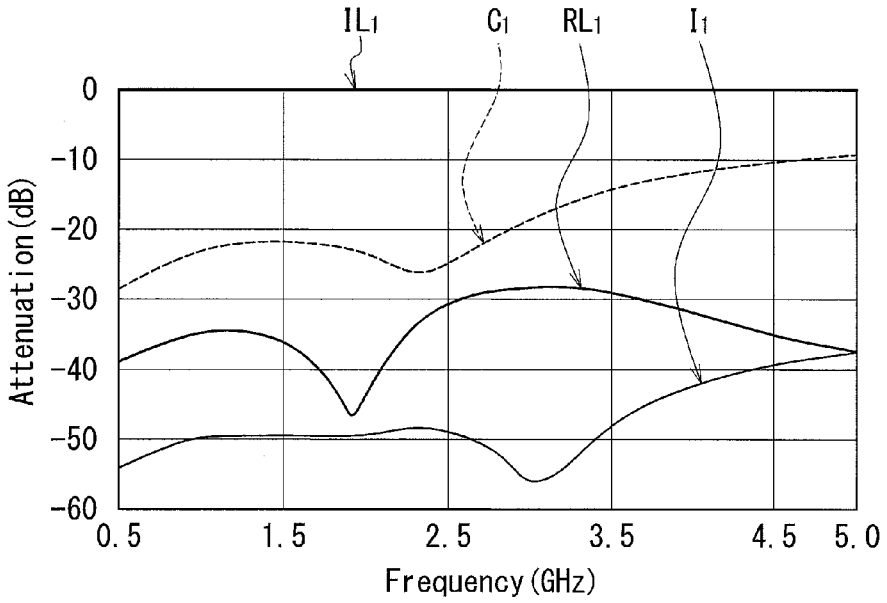
FIG. 14 is a characteristic diagram illustrating an example of characteristics of the directional coupler according to the first embodiment of the invention.

FIG. 14 is a characteristic diagram illustrating an example of characteristics of the directional coupler 1. In FIG. 14 the horizontal axis represents frequency, and the vertical axis represents attenuation. In FIG. 14, the line labeled $IL_1$ indicates the insertion loss of the directional coupler 1; the line labeled $C_1$ indicates the coupling of the directional coupler 1; the line labeled $I_1$ indicates the isolation of the directional coupler 1; and the line labeled $RL_1$ indicates the return loss at the coupling port 13 of the directional coupler 1.

For the directional coupler 1, where the isolation and the return loss at the coupling port 13 thereof are denoted as −i (dB) and −r (dB), respectively, the value of i is approximately 37 or above and the value of r is approximately 28 or above in the 0.5- to 5.0-GHz frequency band. These values of i and r are both sufficiently large.

In the example shown in FIG. 13 and FIG. 14, a high frequency signal passes through the matching circuit 30 in at least the 0.5- to 5.0-GHz frequency band. Accordingly, the directional coupler 1 works in at least the 0.5- to 5.0-GHz frequency band. The directional coupler 1 is thus usable in at least the 0.5- to 5.0-GHz frequency band.

A significant difference of the matching circuit 30 from the low-pass filter 130 is that in the matching circuit 30 there exists no path connecting the signal path between the first subline section 20A and the second subline section 20B to the ground via a capacitor only, and instead, the second inductor L2 is interposed between the aforementioned signal path and the ground without exception. Consequently, the matching circuit 30 is able to allow a high frequency signal to pass therethrough even in a high frequency band not lower than the cut-off frequency of the low-pass filter 130.

As has been described, the directional coupler 1 according to the first embodiment is able to suppress a change in the coupling of the directional coupler 1 in response to a change in the frequency of the high frequency signal. Further, the matching circuit 30 of the first embodiment is able to allow a high frequency signal to pass therethrough over a wider frequency band when compared with the low-pass filter 130. The directional coupler 1 according to the first embodiment is therefore wideband capable. Thus, the directional coupler 1 according to the first embodiment is usable for multiple signals in multiple frequency bands used in CA.

A previously mentioned, the second inductor L2 in the matching circuit 30 has an inductance higher than or equal to 0.1 nH. Typically, in a stack that is used to form an electronic component and includes a plurality of stacked dielectric layers and conductor layers, any conductor layer connected to the ground has a stray inductance lower than 0.1 nH. The inductance of the second inductor L2, which is higher than or equal to 0.1 nH, is therefore clearly distinguishable from the stray inductance.

Second Embodiment

Figure 15:
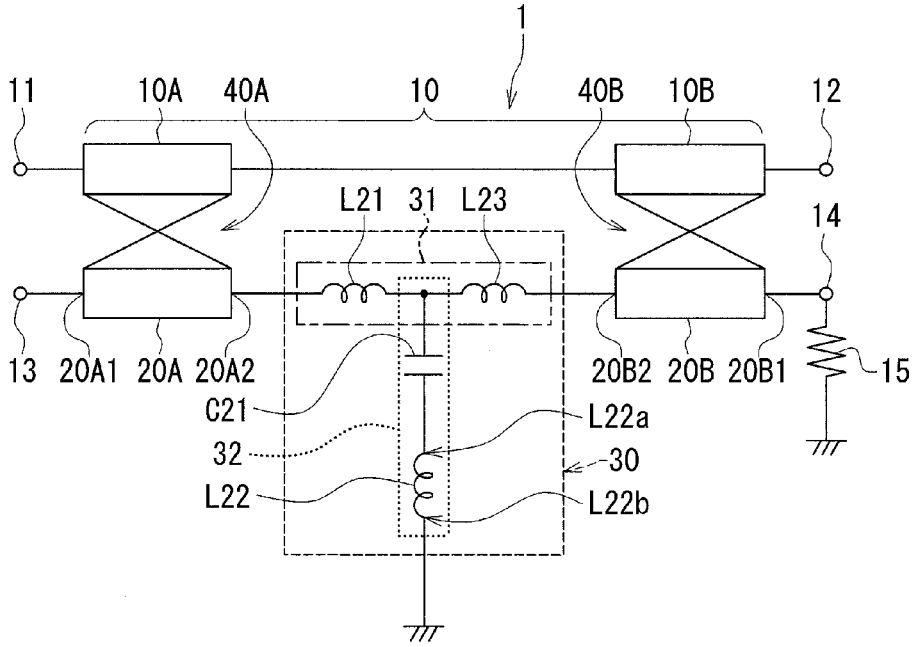
FIG. 15 is a circuit diagram illustrating the circuitry of a directional coupler according to a second embodiment of the invention.

A directional coupler 1 according to a second embodiment of the invention will now be described with reference to FIG. 15. FIG. 15 is a circuit diagram illustrating the circuitry of the directional coupler 1 according to the second embodiment. In the directional coupler 1 according to the second embodiment, the matching circuit 30 is configured differently than the first embodiment.

The matching circuit 30 of the second embodiment includes a first path 31 connecting the second end 20A2 of the first subline section 20A and the second end 20B2 of the second subline section 20B, and a second path 32 connecting the first path 31 and the ground, like the first embodiment. The first path 31 includes a first inductor L21, and a third inductor L23 connected to the first inductor L21 in series.

FIG. 15 illustrates an example in which one end of the first inductor L21 is connected to the second end 20A2 of the first subline section 20A, one end of the third inductor L23 is connected to the second end 20B2 of the second subline section 20B, and the respective other ends of the first inductor L21 and the third inductor L23 are connected to each other. In the second embodiment, however, the locations of the first inductor L21 and the second inductor L23 may be opposite to those in the example shown in FIG. 15.

The second path 32 includes a first capacitor C21 and a second inductor L22 connected in series. The second inductor L22 has a first end L22*a* and a second end L22*b*. In terms of circuitry, the first end L22*a* is closest to the first path 31, and the second end L22*b* is closest to the ground. The first capacitor C21 is provided between the first end L22*a* of the second inductor L22 and the connection point between the first inductor L21 and the third inductor L23. The second inductor L22 has an inductance higher than or equal to 0.1 nH. The inductance of the second inductor L22 is preferably not higher than 7 nH.

The matching circuit 30 of the second embodiment has functions similar to those of the matching circuit 30 of the first embodiment. The remainder of configuration, operation and effects of the second embodiment are similar to those of the first embodiment.

The present invention is not limited to the foregoing embodiments, and various modifications may be made thereto. For example, the configuration of the matching circuit of the present invention is not limited to that illustrated in each embodiment, and can be modified in various ways as far as the requirements of the appended claims are met.

Obviously, many modifications and variations of the present invention are possible in the light of the above teachings. Thus, it is to be understood that, within the scope of the appended claims and equivalents thereof, the invention may be practiced in other than the foregoing most preferable embodiments.

What is claimed is:

1. A directional coupler comprising:

an input port;

an output port;

a coupling port;

a terminal port;

a main line connecting the input port and the output port; and a first subline section and a second subline section each of which is formed of a line configured to be electromagnetically coupled to the main line; and a matching circuit provided between the first subline section and the second subline section, wherein each of the first subline section and the second subline section has a first end and a second end opposite to each other, the first end of the first subline section is connected to the coupling port, the first end of the second subline section is connected to the terminal port, the matching circuit includes a first path connecting the second end of the first subline section and the second end of the second subline section, and a second path connecting the first path and a ground, the first path includes a first inductor, and the second path includes a first capacitor and a second inductor connected in series.

2. The directional coupler according to claim 1, wherein the second inductor has a first end and a second end, the first end being closest to the first path in terms of circuitry, the second end being closest to the ground in terms of circuitry, the first capacitor is provided between one end of the first inductor and the first end of the second inductor, and the second path further includes a second capacitor provided between the other end of the first inductor and the first end of the second inductor.

3. The directional coupler according to claim 1, wherein the first path further includes a third inductor connected to the first inductor in series, the second inductor has a first end and a second end, the first end being closest to the first path in terms of circuitry, the second end being closest to the ground in terms of circuitry, and the first capacitor is provided between the first end of the second inductor and a connection point between the first inductor and the third inductor.

4. The directional coupler according to claim 1, wherein the second inductor has an inductance higher than or equal to 0.1 nH.

* * * * *